US011135713B2

(12) United States Patent
Kao

(10) Patent No.: US 11,135,713 B2
(45) Date of Patent: Oct. 5, 2021

(54) SOCKET HOLDING FRAME ASSEMBLY

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 16/033,484

(22) Filed: Jul. 12, 2018

(65) Prior Publication Data

US 2020/0016736 A1 Jan. 16, 2020

(51) Int. Cl.
*B25H 3/00* (2006.01)
*B65D 73/00* (2006.01)

(52) U.S. Cl.
CPC ..... *B25H 3/003* (2013.01); *B65D 73/00* (2013.01)

(58) Field of Classification Search
CPC . B25H 3/003; B25H 3/04; B25H 3/00; B65D 73/00
USPC ..... 206/378
See application file for complete search history.

(56) References Cited

U.S. PATENT DOCUMENTS

| | | | | |
|---|---|---|---|---|
| 3,537,288 | A * | 11/1970 | Ansingh | B21H 3/027 72/88 |
| 4,621,738 | A * | 11/1986 | DeLucchi | B25H 3/003 206/378 |
| 5,467,874 | A | 11/1995 | Whitaker | |
| 6,168,018 | B1 | 1/2001 | Ramsey et al. | |
| 9,821,451 | B1 * | 11/2017 | Kao | B25H 3/04 |
| 9,878,441 | B1 | 1/2018 | Kao | |
| 2001/0001197 | A1 | 5/2001 | Ramsey et al. | |
| 2005/0218023 | A1 | 10/2005 | Winnard | |
| 2011/0089126 | A1 * | 4/2011 | Hsieh | B25H 3/06 211/70.6 |
| 2013/0062480 | A1 | 3/2013 | Kao | |
| 2017/0274522 | A1 | 9/2017 | Kao | |

FOREIGN PATENT DOCUMENTS

| | | | |
|---|---|---|---|
| CA | 2928991 | A1 | 11/2017 |
| GB | 2507040 | A | 4/2014 |
| GB | 2514844 | A | 12/2014 |
| JP | 2008-105104 | A | 5/2008 |
| JP | 2015-182150 | A | 10/2015 |
| JP | 2016-30297 | A | 3/2016 |

* cited by examiner

*Primary Examiner* — Anthony D Stashick
*Assistant Examiner* — L Kmet
(74) *Attorney, Agent, or Firm* — Muncy, Geissler, Olds & Lowe, P.C.

(57) ABSTRACT

A socket holding frame assembly has a track base, multiple holding bases, and multiple fasteners. The track base has a bottom panel, a track channel, and a connection portion. The track channel is defined in the bottom panel. The connection portion is formed through the bottom panel. The holding bases are mounted slidably and rotatably in the track channel in the track base. Each holding base has a connection hole defined in a bottom of the holding base. The fasteners are mounted through the connection portion in the bottom panel from a bottom surface of the bottom panel and are screwed respectively into the connection holes in the holding bases.

5 Claims, 17 Drawing Sheets

SOCKET HOLDING FRAME ASSEMBLY

BACKGROUND OF THE INVENTION

1. Field of the Invention

The present invention relates to a socket holding frame assembly, and more particularly to a socket holding frame assembly that can hold a position and a direction of a socket securely.

2. Description of Related Art

With reference to FIG. 15, a conventional socket holding frame substantially comprises a holding base 60. Multiple holding holes 62 in different diameters are formed in a top surface of the holding base 60, such that sockets can be inserted and held in the holding holes 62.

However, the conventional socket holding frame can only hold sockets having specific diameters, and the positions of the sockets cannot be changed or adjusted. Therefore, the conventional socket holding frame is not versatile and convenient in use.

With reference to FIG. 16, another conventional socket holding frame is shown and substantially comprises a track base 70 and multiple holding bases 72. The track base 70 is elongated and has a track 702 formed on and protruding from a top surface of the track base 70. The holding bases 72 are mounted slidably around and on the track 702 of the track base 70. Accordingly, sockets can be held on the holding bases 72, and the positions of the sockets on the track base 70 are adjustable.

However, the holding bases 72 of the conventional socket holding frame are not rotatable relative to the track base 70. Therefore, after a socket is held on one of the holding bases 72, the direction of the socket is fixed and is not rotatable and adjustable. Thus, to check the dimension mark on the socket is inconvenient. In addition, the holding bases 72 cannot be held securely on the track base 70, so the holding bases 72 are easily moved unintentionally relative to the track base 70 when an external force is applied to the socket holding frame.

With reference to FIG. 17, further another conventional socket holding frame is shown and substantially comprises a track base 80 and multiple holding bases 82. The track base 80 is elongated and has a track channel 802 defined in a top surface of the track base 80, the holding bases 82 are mounted slidably and rotatably in the track channel 802 in the track base 80. Sockets are mounted on the holding bases 82, and the positions and directions of the sockets can be adjusted by moving or rotating the holding bases 82 relative to the track base 80.

However, the holding bases 82 can be held at predetermined positons and directions firmly, so the sockets on the holding bases 82 are easily moved or rotated unintentionally when an external force is applied to the socket holding frame. Therefore, the conventional socket holding frame is not convenient in use.

To overcome the shortcomings, the present invention tends to provide a socket holding frame assembly to mitigate or obviate the aforementioned problems.

SUMMARY OF THE INVENTION

The main objective of the invention is to provide a socket holding frame assembly that can hold sockets at fixed positions and in fixed directions securely.

The socket holding frame assembly has a track base, multiple holding bases, and multiple fasteners. The track base has a bottom panel, a track channel, and a connection portion. The track channel is defined in the bottom panel. The connection portion is formed through the bottom panel. The holding bases are mounted slidably and rotatably in the track channel in the track base. Each holding base has a connection hole defined in a bottom of the holding base. The fasteners are mounted through the connection portion in the bottom panel from a bottom surface of the bottom panel and are screwed respectively into the connection holes in the holding bases.

Other objects, advantages and novel features of the invention will become more apparent from the following detailed description when taken in conjunction with the accompanying drawings.

DETAILED DESCRIPTION OF PREFERRED EMBODIMENT

Figure 1:
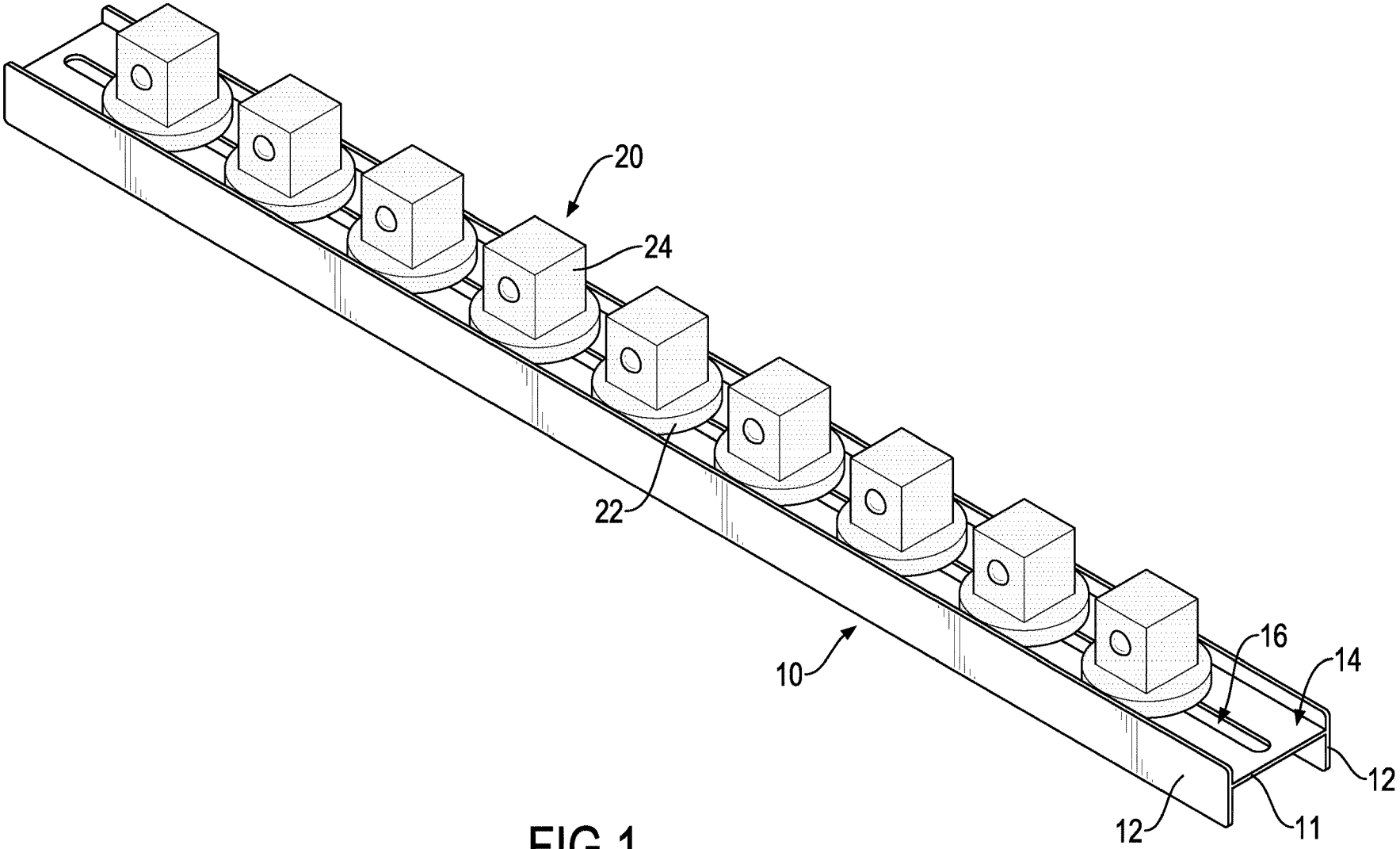
FIG. 1 is a perspective view of a first embodiment of a socket holding frame assembly in accordance with the present invention.
Figure 2:
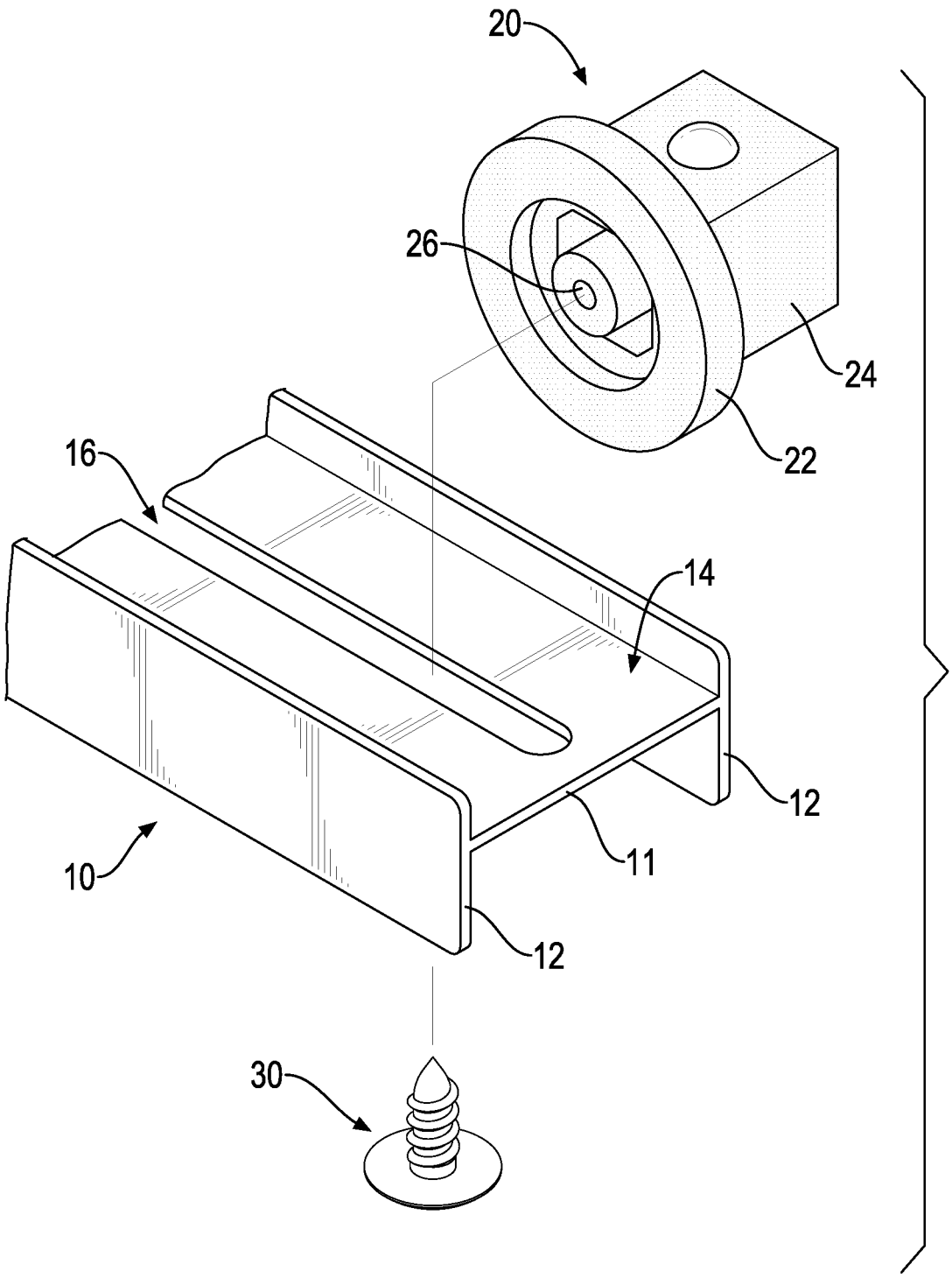
FIG. 2 is an enlarged exploded perspective view of the socket holding frame assembly in FIG. 1.
Figure 3:
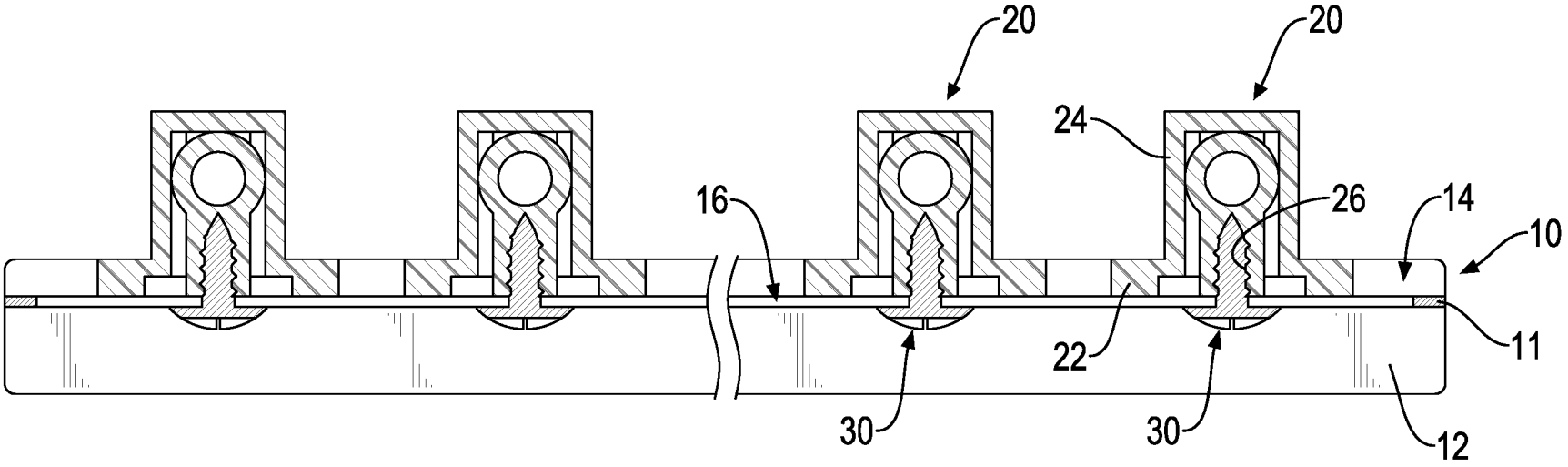
FIG. 3 is an enlarged side view in partial section of the socket holding frame assembly in FIG. 1.
Figure 4:
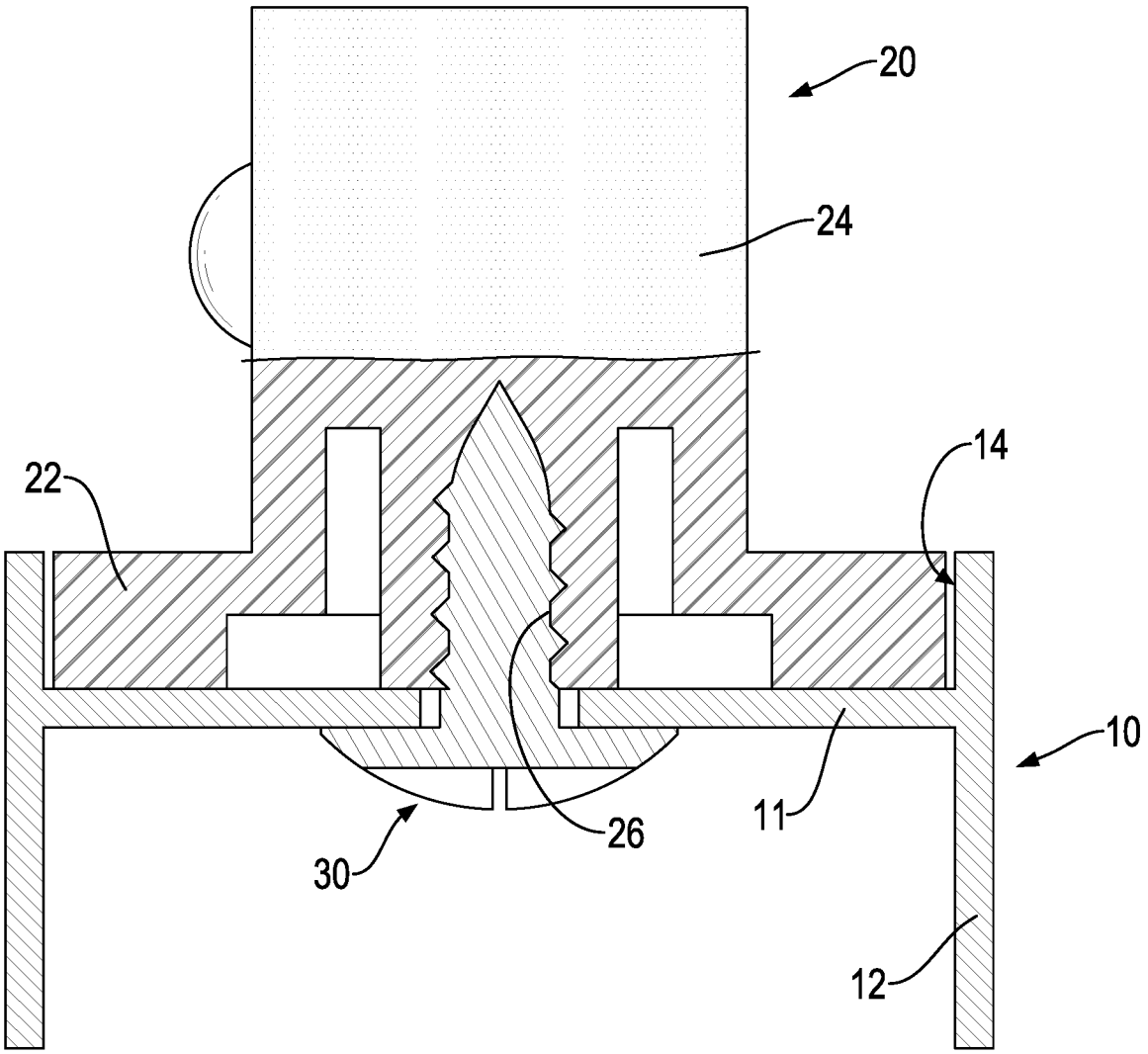
FIG. 4 is an enlarged end view in partial section of the socket holding frame assembly in FIG. 1.
Figure 5:
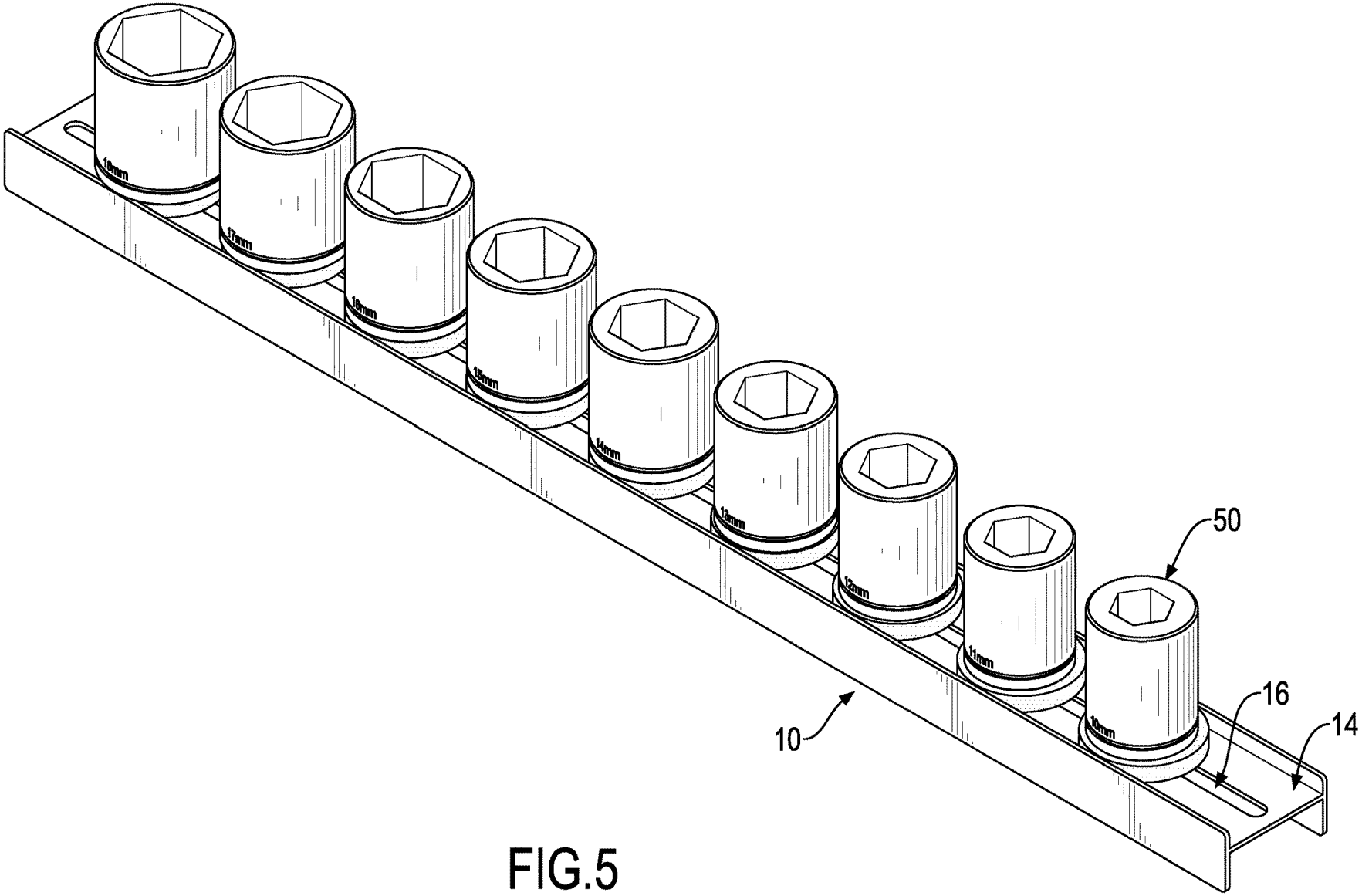
FIG. 5 is an operational perspective view of the socket holding frame assembly in FIG. 1.
Figure 6:
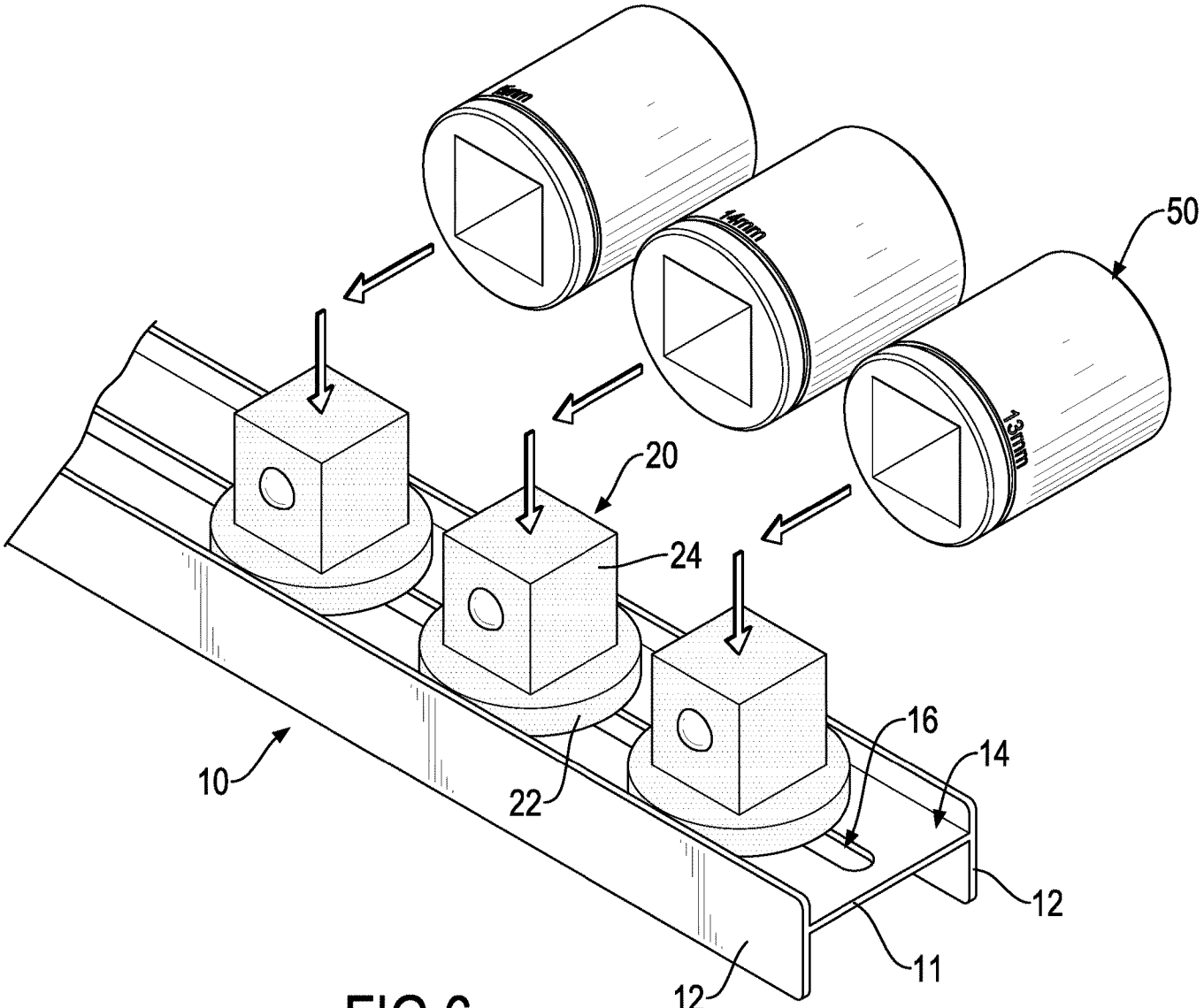
FIG. 6 is an enlarged operational exploded perspective view of the socket holding frame assembly in FIG. 1.
Figure 7:
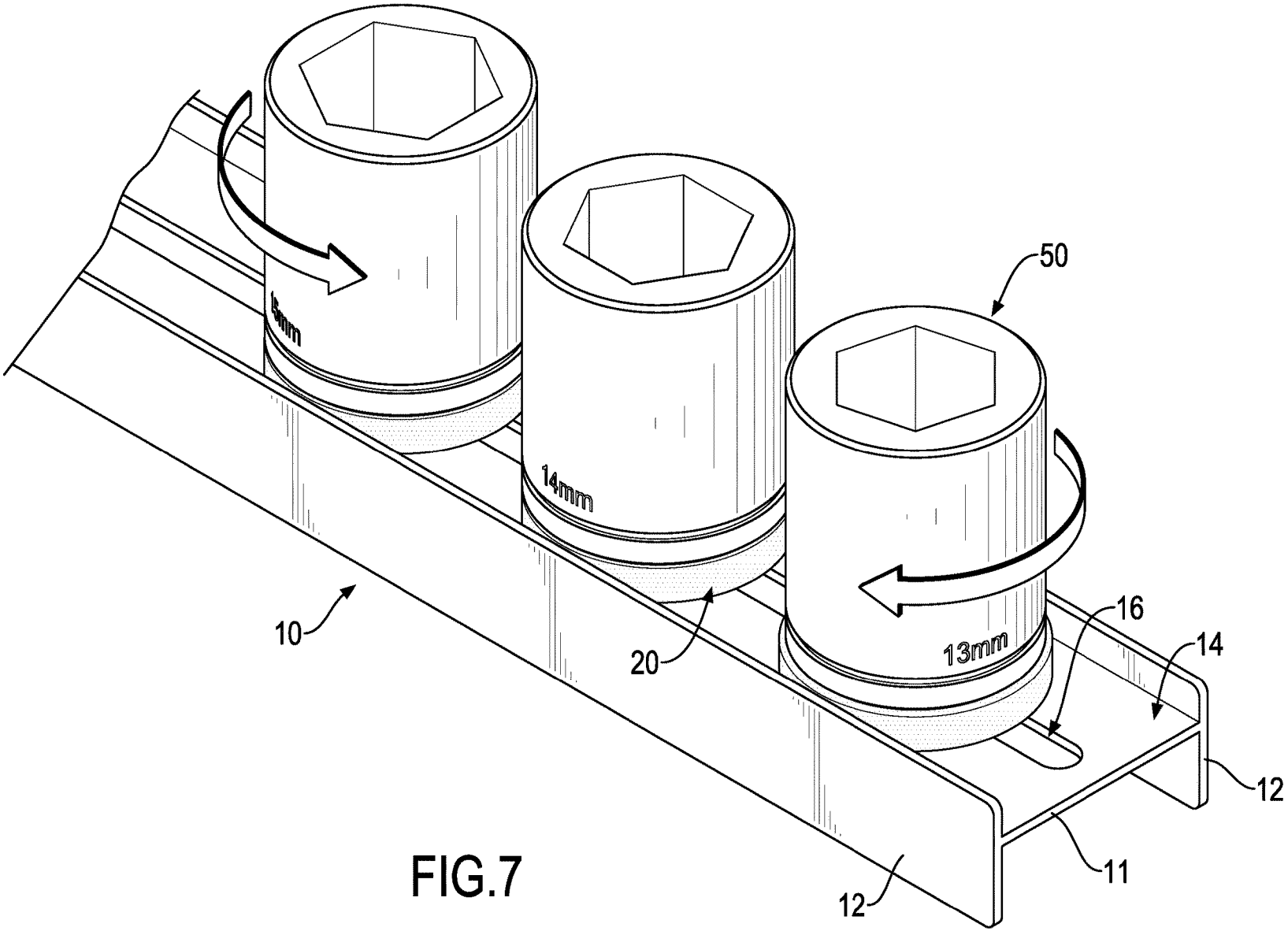
FIG. 7 is an enlarged operational perspective view of the socket holding frame assembly in FIG. 1.
Figure 8:
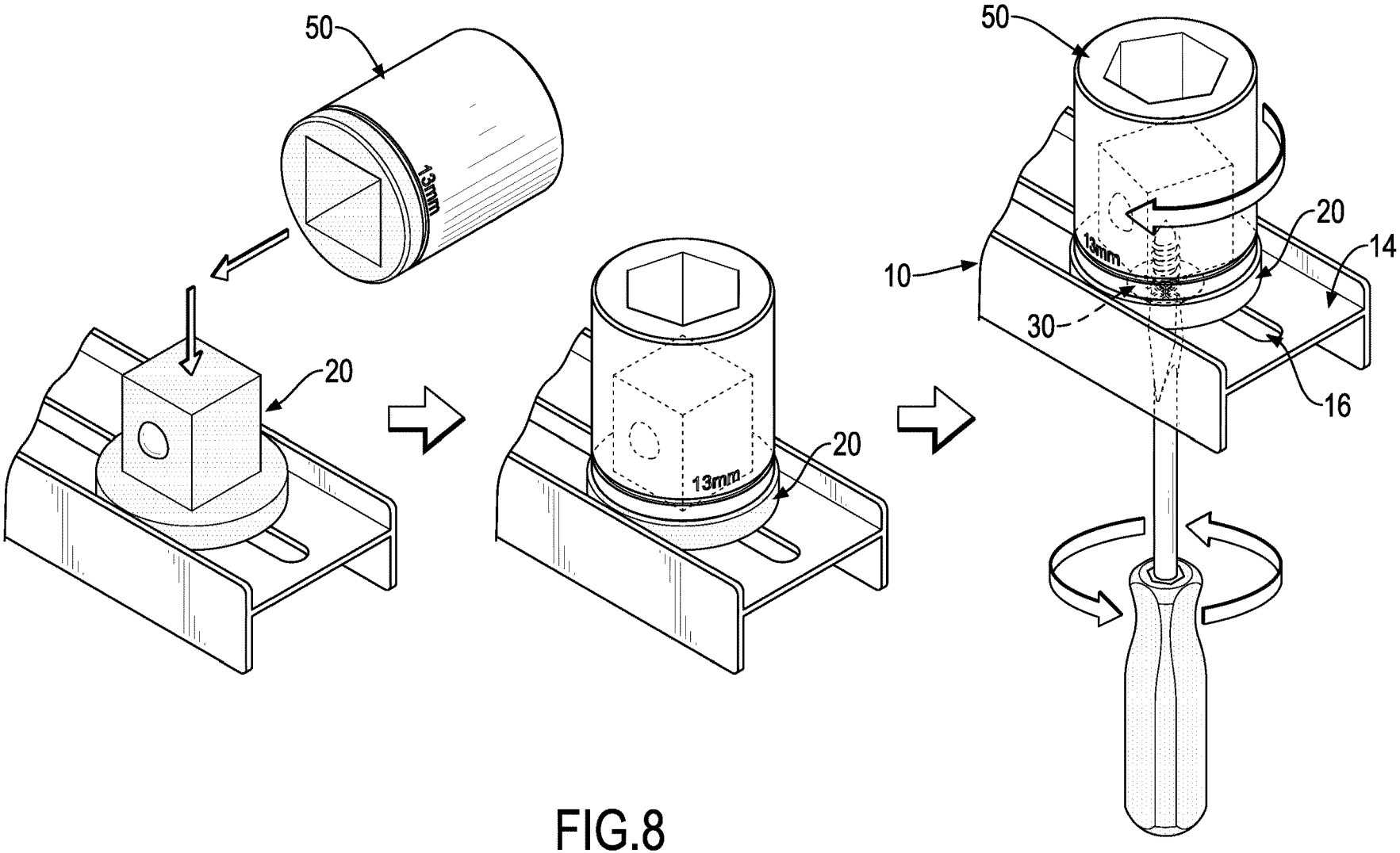
FIG. 8 shows operational perspective views of the socket holding frame assembly in FIG. 1.

With reference to FIGS. 1 to 4, a socket holding frame assembly in accordance with the present invention comprises a track base 10, multiple holding bases 20, and multiple fasteners 30.

The track base 10 is elongated, has an H-shaped cross section, and comprises a bottom panel 11 and two side panels 12. The bottom panel 11 has a flat top surface and a bottom surface. The side panels 12 are connected respectively with two sides of the bottom panel 11, protrude from a bottom surface of the bottom panel 11 to form an open space in a bottom of the track base 10, and protrude from a top of the bottom panel 11 to define a track channel 14 in the top of the bottom panel 11 and between the top of the bottom panel 11 and the side panels 12. The bottom panel 11 has a connection portion 16 formed through the bottom surface and the flat top surface of the bottom panel 11 and communicating with the track channel 14 and the open space in the bottom of the track base 10. In the first embodiment, the connection portion 16 is an elongated through hole and has two opposite ends respectively spaced from two ends of the bottom panel 11 to form a closed rail slot.

The holding bases 20 are mounted in the track channel 14 in the track base 10 via a top of the track base 10, are slidable and rotatable relative to the track base 10 and each holding base 20 comprises a bottom base 22 and a holding portion 24. The bottom base 22 may be a circular board and is mounted in the track channel 14 in the track base 10 via the top of the track base 10, is slidable and rotatable relative to the track base 10, and has a flat bottom surface defined in a bottom of the holding base 20, slidably and rotatably abutting on the flat top surface of the bottom panel 11 of the track base 10. The holding portion 24 is integrally formed on and protrudes from a top surface of the bottom base 22 and is adapted to connect with a socket. Accordingly, sockets can be put on the track base 10 via the holding bases 20. In addition, each holding base 20 has a respective connection hole 26 defined in the bottom of the holding base 20 and aligned with the connection portion 16 in the bottom panel 11 of the track base 10.

The fasteners 30 are mounted in the open space in the track base 10 via the bottom of the track base 10, are mounted through the connection portion 16 in the bottom panel 11 from the bottom surface of the bottom panel 11, and are screwed into the connection holes 26 in the holding bases 20 respectively to limit the holding bases 20 to rotatably slide along the connection portion 16 between the two opposite ends of the connection portion 16 in the bottom panel 11. Accordingly, the holding bases 20 can be held in position securely by the fasteners 30. In the first embodiment, each fastener 30 is a self-tapping screw, and the connection holes 26 in the holding bases 20 are blind holes. In an alternative embodiment, each fastener 30 is a bolt, and the connection holes 26 in the holding bases 20 are threaded holes.

In use, with reference to FIGS. 5 to 8, the holding bases 20 are put into the track channel 14 from an end of the track base 10, and sockets 50 are respectively put onto the holding portions 24 of the holding bases 20. The sockets 50 are rotated to make the dimension marks on the sockets 50 face a same direction. The fasteners 30 are then inserted through the connection portion 16 in the bottom panel 11 from the bottom surface of the bottom panel 11 and are screwed respectively into the connection holes 26 in the holding bases 20. Accordingly, the holding bases 20 with the sockets 50 can be held securely at desired positions and in desired directions. Thus, a user can clearly recognize the dimensions of the sockets 50 and takes the sockets 50 for use conveniently.

Because the holding bases 20 are securely held on the track base 10 by the fasteners 30, the positions and directions of the holding bases 20 will not be changed unintentionally even when an external force is applied to the socket holding frame assembly. Therefore, the use of the socket holding frame assembly is stable and convenient. To change the positions or directions of the holding bases 20 and the sockets 50, the fasteners 30 are released and the holding bases 20 can be moved or rotated relative to the track channel 14 in the track base 10. After the holding bases 20 are moved to desired positions or directions, the fasteners 30 are screwed into the connection holes 26 in the holding bases 20. Consequently, the positons and directions of the sockets 50 can be conveniently adjusted.

In practice, multiple sockets 50 having different sizes are mounted on the holding portions 24 of the holding bases 20 and are arranged along the track base 10 by size. Accordingly, the sockets 50 can be well classified on the track base 10 and are easily taken for use.

Figure 9:
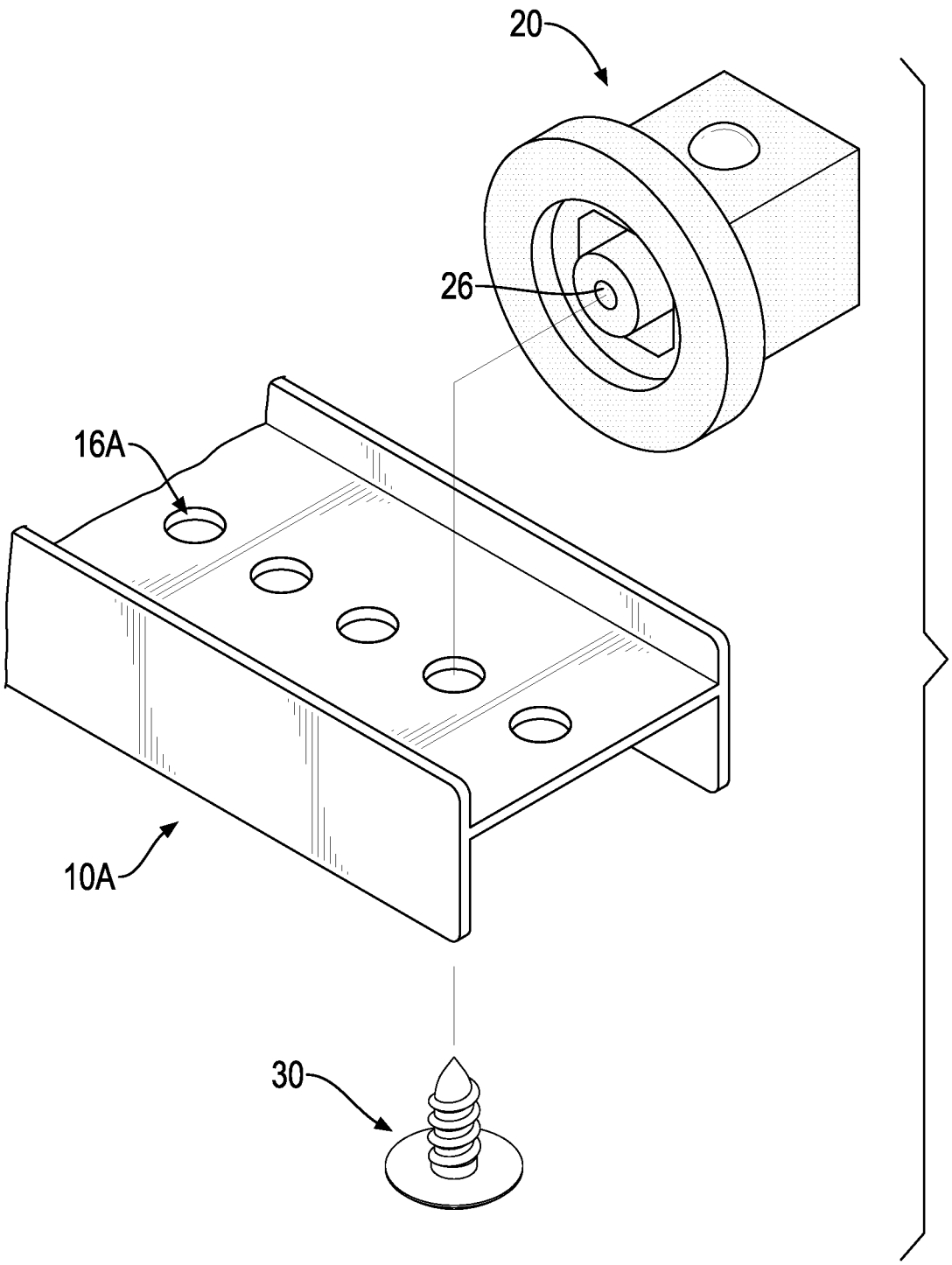
FIG. 9 is an exploded perspective view of a second embodiment of a socket holding frame assembly in accordance with the present invention.
Figure 10:
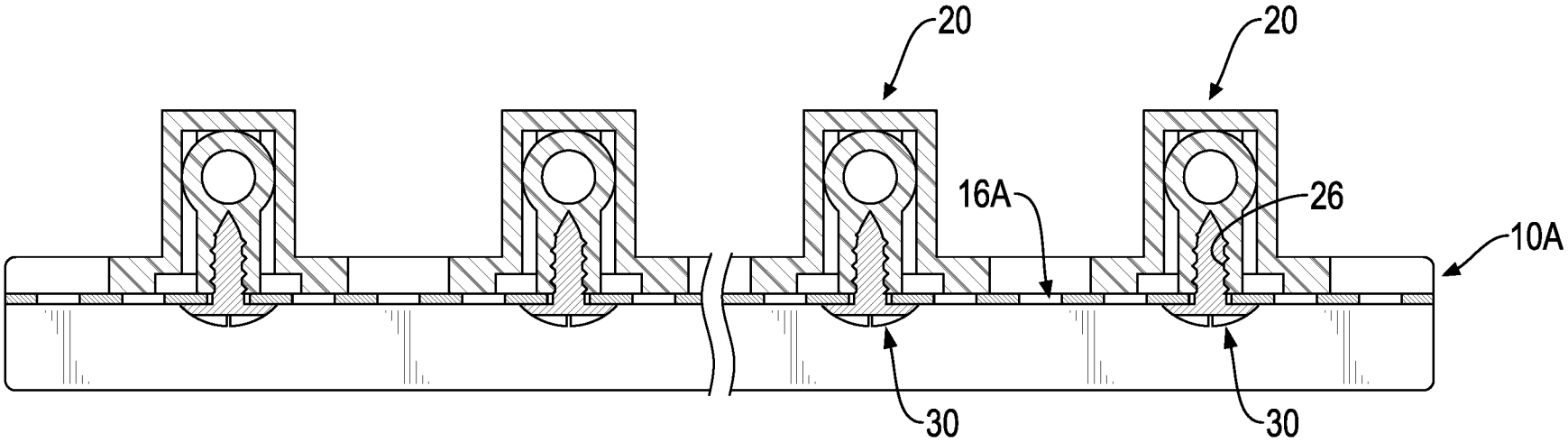
FIG. 10 is a side view in partial section of the socket holding frame assembly in FIG. 9.
Figure 11:
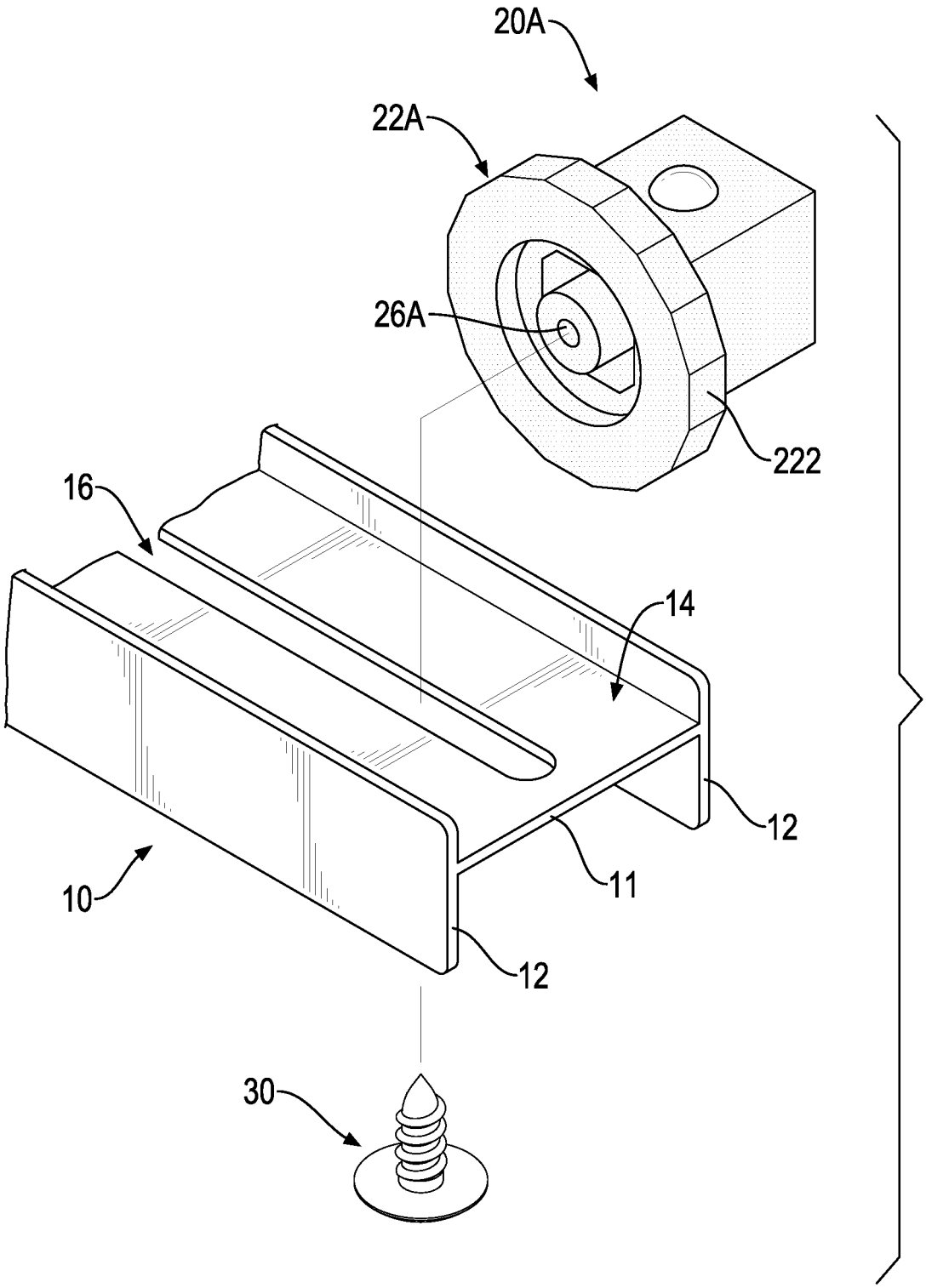
FIG. 11 is an exploded perspective view of a third embodiment of a socket holding frame assembly in accordance with the present invention.
Figure 12:
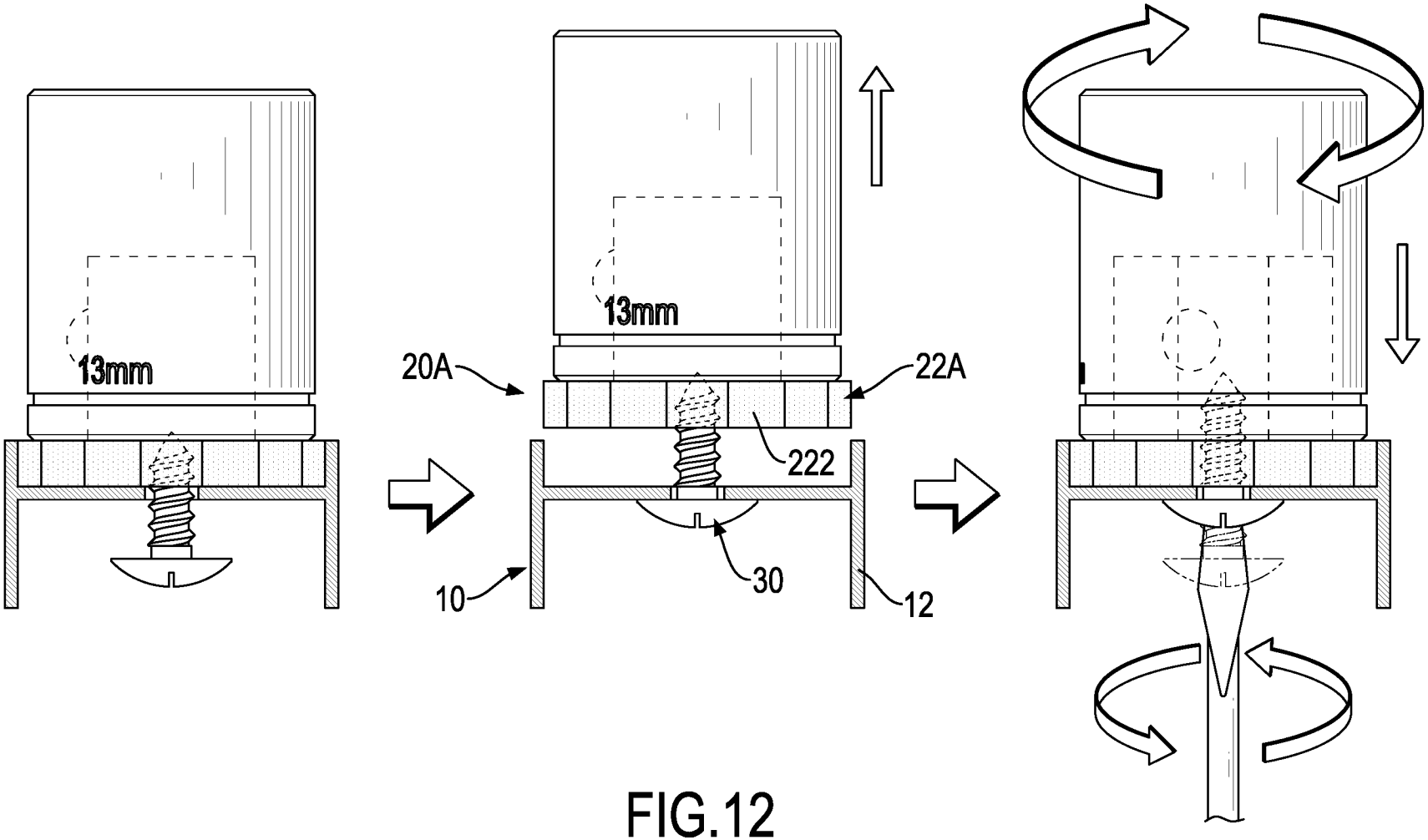
FIG. 12 shows operational side views in partial section of the socket holding frame assembly in FIG. 11.
Figure 13:
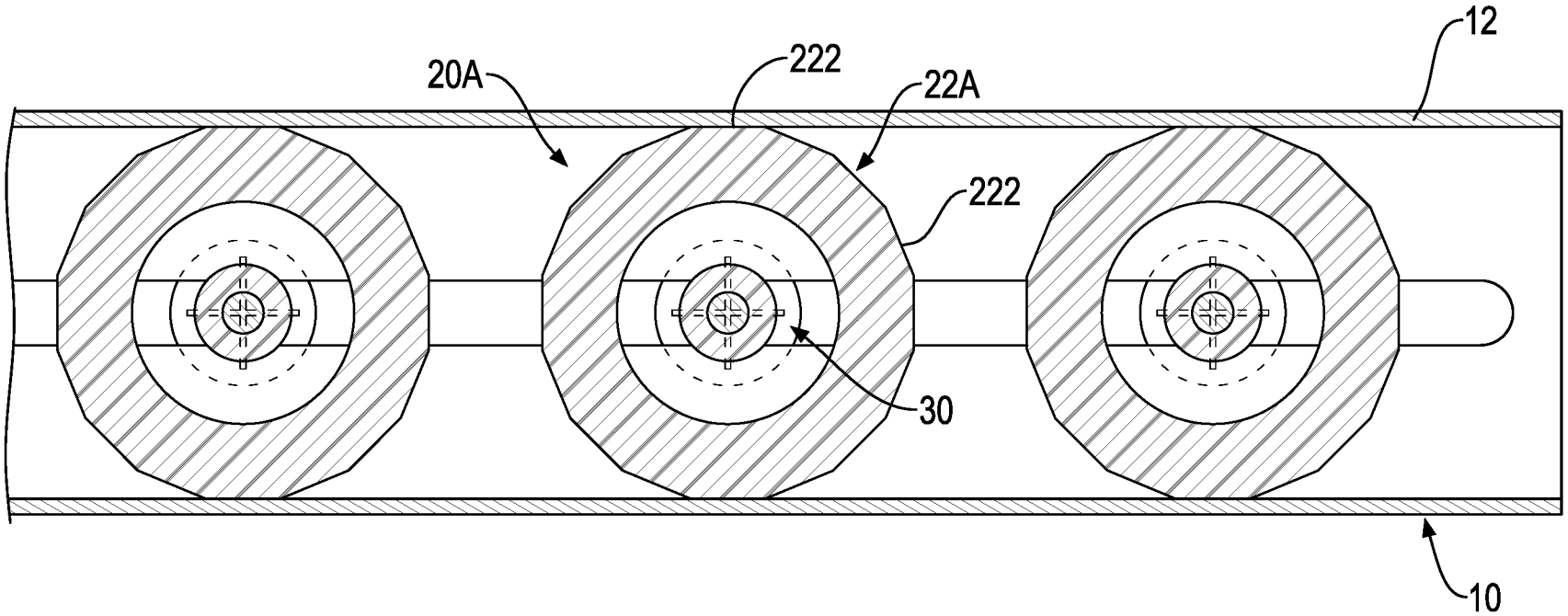
FIG. 13 is a cross sectional top view of the socket holding frame assembly in FIG. 11.
Figure 14:
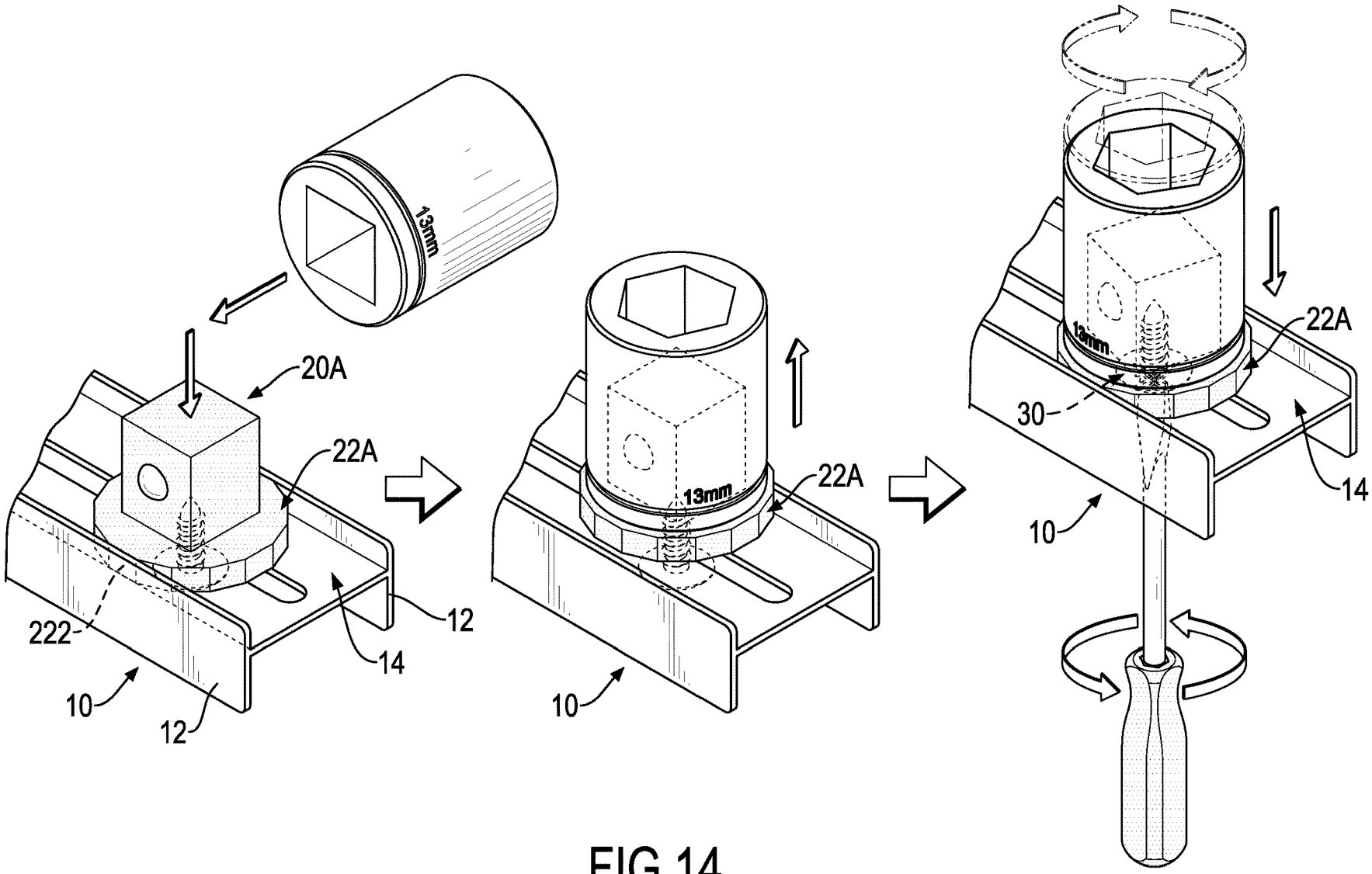
FIG. 14 shows operational perspective views of the socket holding frame assembly in FIG. 11.
Figure 15:
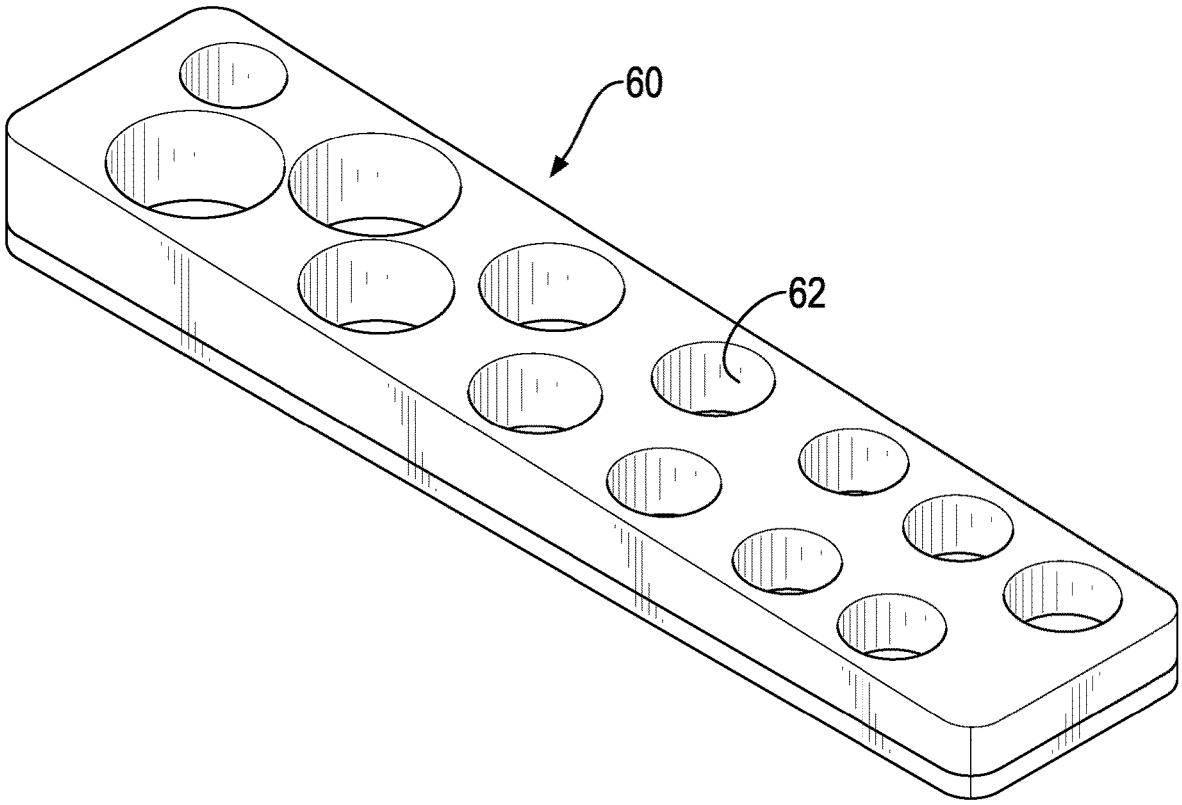
FIG.15 PRIOR ART
FIG. 15 is a perspective view of a conventional socket holding frame.
Figure 16:
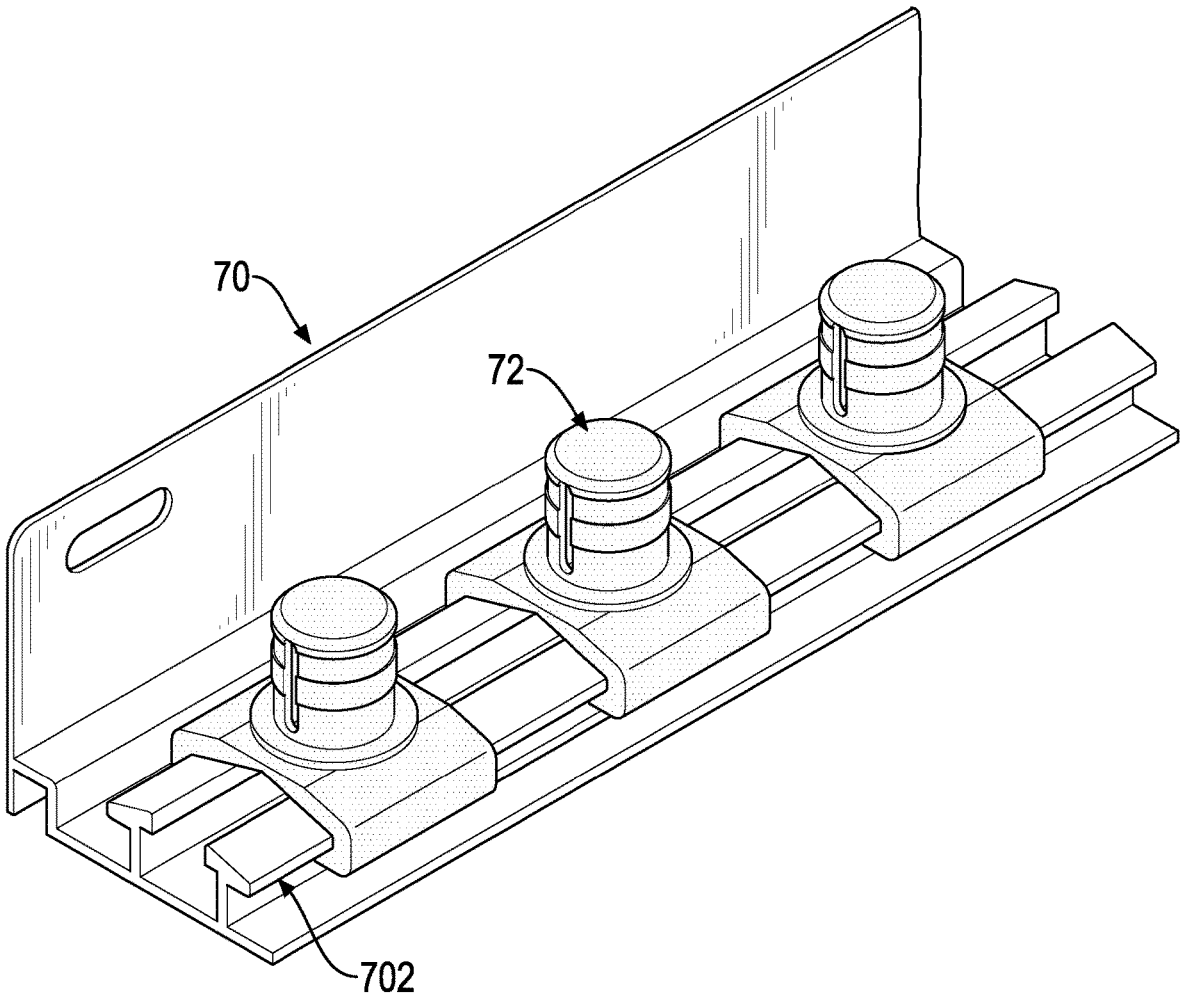
FIG.16 PRIOR ART
FIG. 16 is a perspective view of another conventional socket holding frame.
Figure 17:
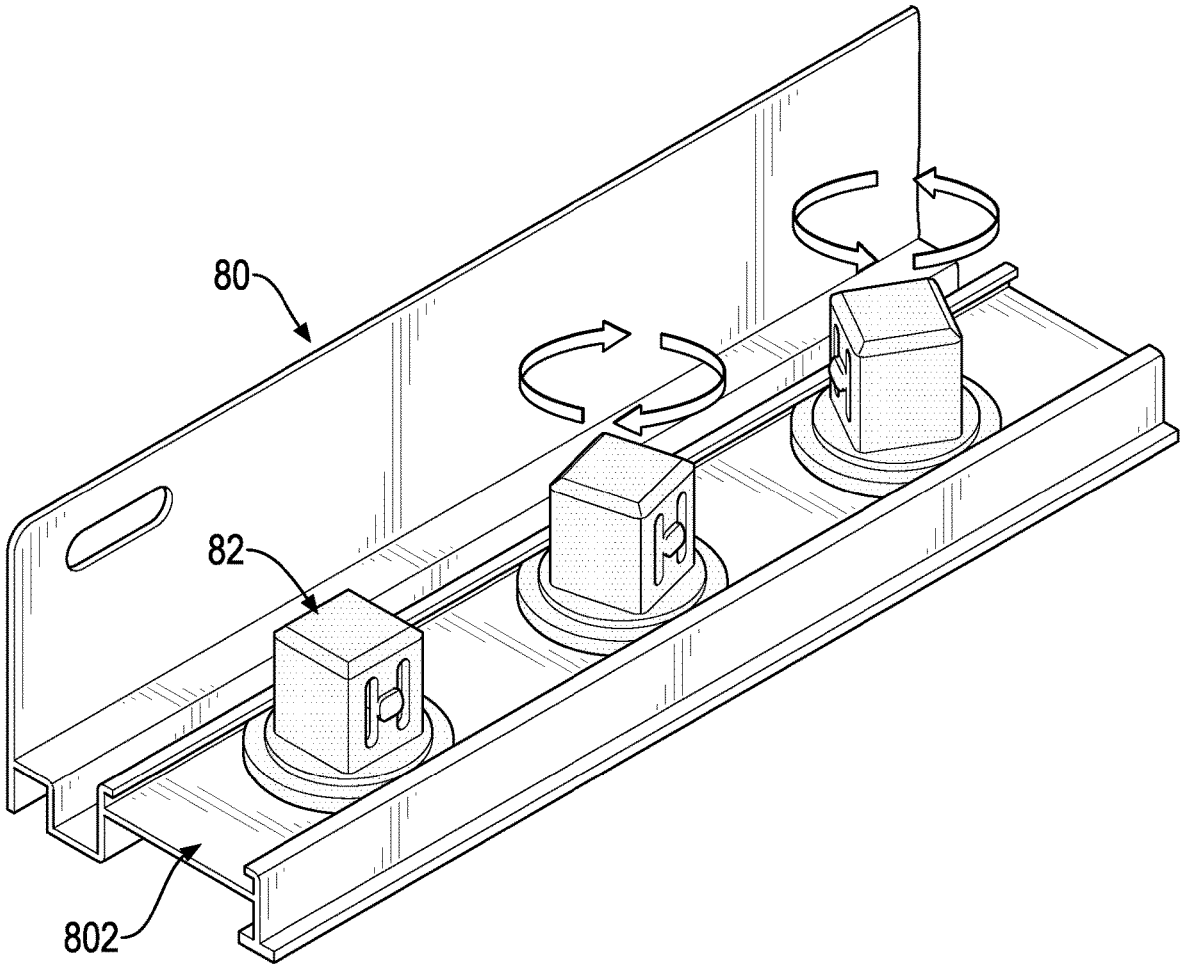
FIG.17 PRIOR ART
FIG. 17 is a perspective view of further another conventional socket holding frame.

With reference to FIGS. 9 and 10, in the second embodiment, the connection portion 16A on the track base 10A is composed of multiple circular through holes arranged in a line. Accordingly, when one holding base 20 is moved to align with one of the through holes, the fastener 30 is inserted through the through hole and is screwed into the connection hole 26 in the holding base 20 to hold the holding base 20 in position. After the fastener 30 is released, the position and direction of the holding base 20 can also be adjusted.

With reference to FIGS. 11 to 14, in the third embodiment, the bottom base 22A of each holding base 20A is a polygonal board and has two abutment surfaces 222. When the bottom bases 22A of the holding bases 20A are mounted in the track channel 14 in the track base 10, the abutment surfaces 222 of each holding base 20A can abut two opposite sides of the track channel 14 and preferably abut the side panels 12. With such an arrangement, the holding bases 20A are sill rotatable relative to the track base 10 and can be kept from being rotated while the fastener 30 is screwed into the connection hole 26A in the holding base 20A. Therefore, to lock or to release the holding bases 20A is convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket holding frame assembly comprising:

a track base having a bottom panel having a flat top surface and a bottom surface;

two side panels connected with two sides of the bottom panel and protruding from the bottom surface of the bottom panel to form an open space in a bottom of the track base;

a track channel defined in a top of the bottom panel; and a connection portion being an elongated through hole formed through the bottom surface and the flat top surface of the bottom panel, communicating with the track channel and the open space in the bottom of the track base, and having two opposite ends respectively spaced from two ends of the bottom panel to form a closed rail slot;

multiple holding bases mounted in the track channel in the track base via a top of the track base, being slidable and rotatable relative to the track base, and each holding base having a bottom base mounted in the track channel in the track base via the top of the track base, being slidable and rotatable relative to the track base, and having a flat bottom surface defined in a bottom of the holding base, slidably and rotatably abutting on the flat top surface of the bottom panel of the track base;

a holding portion integrally formed on and protruding from a top surface of the bottom base; and a respective connection hole defined in the bottom of the holding base and aligned with the connection portion in the bottom panel of the track base; and multiple fasteners mounted in the open space in the track base from the bottom of the track base, mounted through the connection portion in the bottom panel from the bottom surface of the bottom panel, and screwed respectively into the connection holes in the holding bases to limit the holding bases to rotatably slide along the connection portion between the two opposite ends of the connection portion in the bottom panel.

2. The socket holding frame assembly as claimed in claim 1, wherein the two side panels protrude from the top of the bottom panel of the track base;

the track base has an H-shaped cross section; and the track channel is defined between the top of the bottom panel and the side panels.

3. The socket holding frame assembly as claimed in claim 2, wherein the bottom base of each holding base is a circular board.

4. The socket holding frame assembly as claimed in claim 3, wherein each fastener is a self-tapping screw and the connection hole of each holding base is a blind hole.

5. The socket holding frame assembly as claimed in claim 1, wherein each fastener is a self-tapping screw and the connection hole of each holding base is a blind hole.

* * * * *